US007156038B2

(12) United States Patent
Brown

(10) Patent No.: US 7,156,038 B2
(45) Date of Patent: Jan. 2, 2007

(54) FRAME FOR ATTACHMENT TO A DOCK STRUCTURE HAVING MEANS TO RECEIVE CONTAINERS

(75) Inventor: John Phillip Brown, New Brunswick (CA)

(73) Assignee: Earth Angel Inc., Fredericton (CA)

( * ) Notice: Subject to any disclaimer, the term of this patent is extended or adjusted under 35 U.S.C. 154(b) by 0 days.

(21) Appl. No.: 10/510,949

(22) PCT Filed: May 12, 2003

(86) PCT No.: PCT/CA03/00686

§ 371 (c)(1),
(2), (4) Date: Oct. 28, 2004

(87) PCT Pub. No.: WO03/097441

PCT Pub. Date: Nov. 27, 2003

(65) Prior Publication Data

US 2005/0223964 A1 Oct. 13, 2005

(30) Foreign Application Priority Data

May 15, 2002 (CA) ..... 2386557

(51) Int. Cl.
*B63B 35/44* (2006.01)

(52) U.S. Cl. ..... 114/267

(58) Field of Classification Search ..... 114/266, 114/267, 363, 364

See application file for complete search history.

(56) References Cited

U.S. PATENT DOCUMENTS

| | | | | |
|---|---|---|---|---|
| 3,592,155 | A | 7/1971 | Rosenberg | |
| 4,988,317 | A | 1/1991 | Rubinsak et al. | |
| 5,020,175 | A | 6/1991 | Kirkpatrick et al. | |
| 5,117,775 | A | 6/1992 | Northam et al. | |
| 5,235,929 | A | 8/1993 | Chester et al. | |
| 5,383,644 | A * | 1/1995 | Huse | 248/523 |
| 5,658,178 | A | 8/1997 | Varga | |
| 5,743,205 | A | 4/1998 | Morris | |
| 6,454,123 | B1 * | 9/2002 | Ritson | 220/630 |

* cited by examiner

*Primary Examiner*—Jesús D. Sotelo
(74) *Attorney, Agent, or Firm*—Dennison, Schultz & MacDonald

(57) ABSTRACT

A frame adapted to receive containers, particularly empty plastic beverage containers, such as two-liter plastic pop bottles, and adapted to be attached to a dock structure. When the dock structure, frame and bottles are in mutual cooperation, the containers provide buoyancy to the dock structure. The containers are preferably screwed into the frame and may be removed.

18 Claims, 4 Drawing Sheets

FRAME FOR ATTACHMENT TO A DOCK STRUCTURE HAVING MEANS TO RECEIVE CONTAINERS

This application is a 371 of PCT/CA03/00686, filed on May 12, 2003.

BACKGROUND OF THE INVENTION

This invention relates generally to flotation devices such as, for example, cottage docks; floating bridges such as those used by all terrain vehicles, lawn tractors, golf carts; island docks, mooring docks for boats; floats for an anchor; or boardwalks. More specifically, the invention relates to a frame into which empty containers such as plastic beverage bottles are screwed and which can be attached to a dock or the like. Hereinafter the term dock structure will be understood to imply one of a cottage dock, floating bridge, island dock, mooring dock for boats, float for an anchor, boardwalk, or other similar structure.

Devices using plastic bottles as a means of flotation have been proposed in the art such as in U.S. Pat. No. 5,235,929 entitled Docking System issued to Leisure Docks Inc. on Aug. 17, 1993. That patent teaches a device made up of several modules, each module comprising a deck and side walls to form a hollow chamber in which plastic containers are adhered to each other, to the side walls, to the deck and to points on the bottom of the module. The device fails to provide an arrangement which allows for easy installation or replacement of bottles by a user. In addition, the patent fails to teach a device adapted for attachment to a dock.

SUMMARY OF THE INVENTION

According to an aspect of the present invention, there is provided a frame for attachment to an underside of a dock structure to provide buoyancy thereto, characterized by a generally planar frame portion; a plurality of receiving members, attached to the frame portion and each adapted to receive a hollow container by holding and sealing an open end of the container, each of the receiving members comprising a plurality of supports extending in an outward radial direction with respect to each receiving member; and means for attaching the frame to the underside of a dock structure, such that the containers depend from the frame and provide a buoyancy effect to the dock structure.

The frame is adapted to be attached to a dock structure and has means to receive empty containers, such as plastic beverage containers. When the dock structure, frame and containers are in mutual cooperation, the containers provide buoyancy to the dock structure. The means for receiving the containers may include female screw portions into which male screw portions of the containers can be screwed, ideally in fluid-tight manner. Preferred containers are two-liter plastic drink bottles. The frame includes a means to allow attachment of the frame to a dock structure such as holes by which the frame may be attached to a dock structure with fastening means such as screws.

According to another aspect of the present invention there is provided a dock system characterized by a dock structure; and a plurality of frames as described above wherein the frames are attached to an underside of said dock structure using said attaching means.

The present invention provides a frame with or without containers associated therewith and with or without a dock structure associated therewith.

A dock structure may be provided with additional features such as, for example, a towing means in order to aid in towing the device on land and/or on water, a ladder, recreational features, and the like.

The arrangement of the frame may be such that when all of the female screw portions are filled with containers, the containers come into contact with each other or, alternatively, such that the bottles are slightly spaced and do not come in contact with each other.

DETAILED DESCRIPTION OF THE PREFERRED EMBODIMENTS

Figure 1:
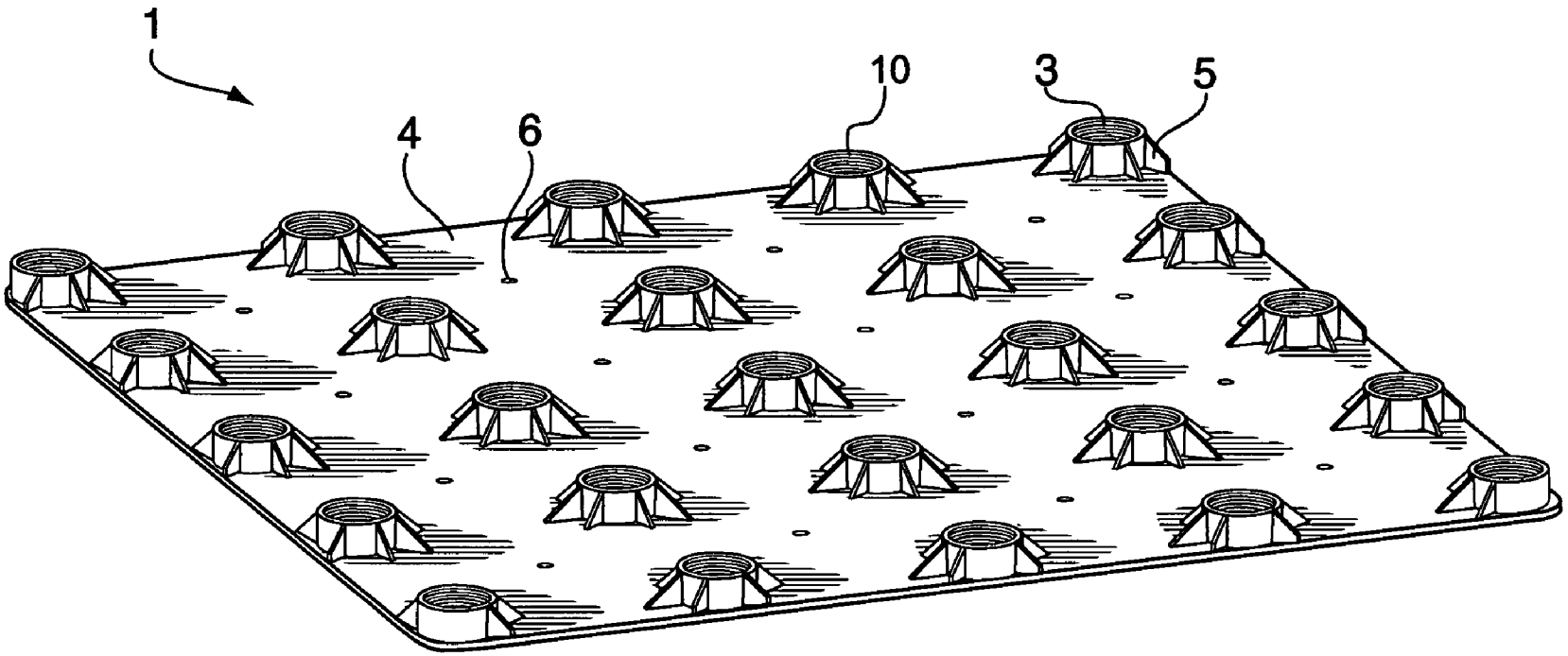
FIG. 1 is a perspective view of a frame according to an embodiment of the present invention.
Figure 2:
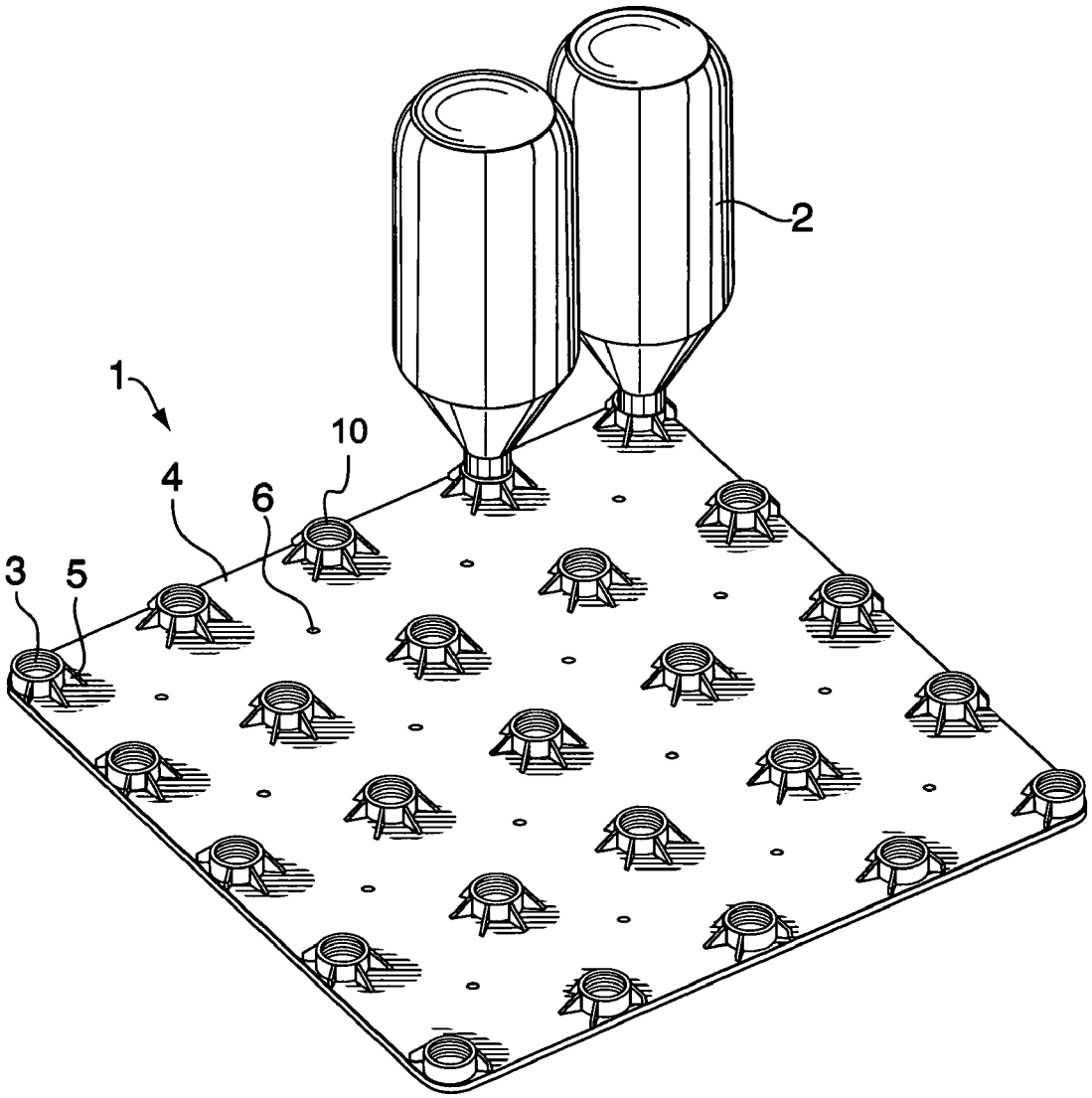
FIG. 2 is a perspective view of the frame of FIG. 1 into which two bottles are screwed.
Figure 3:
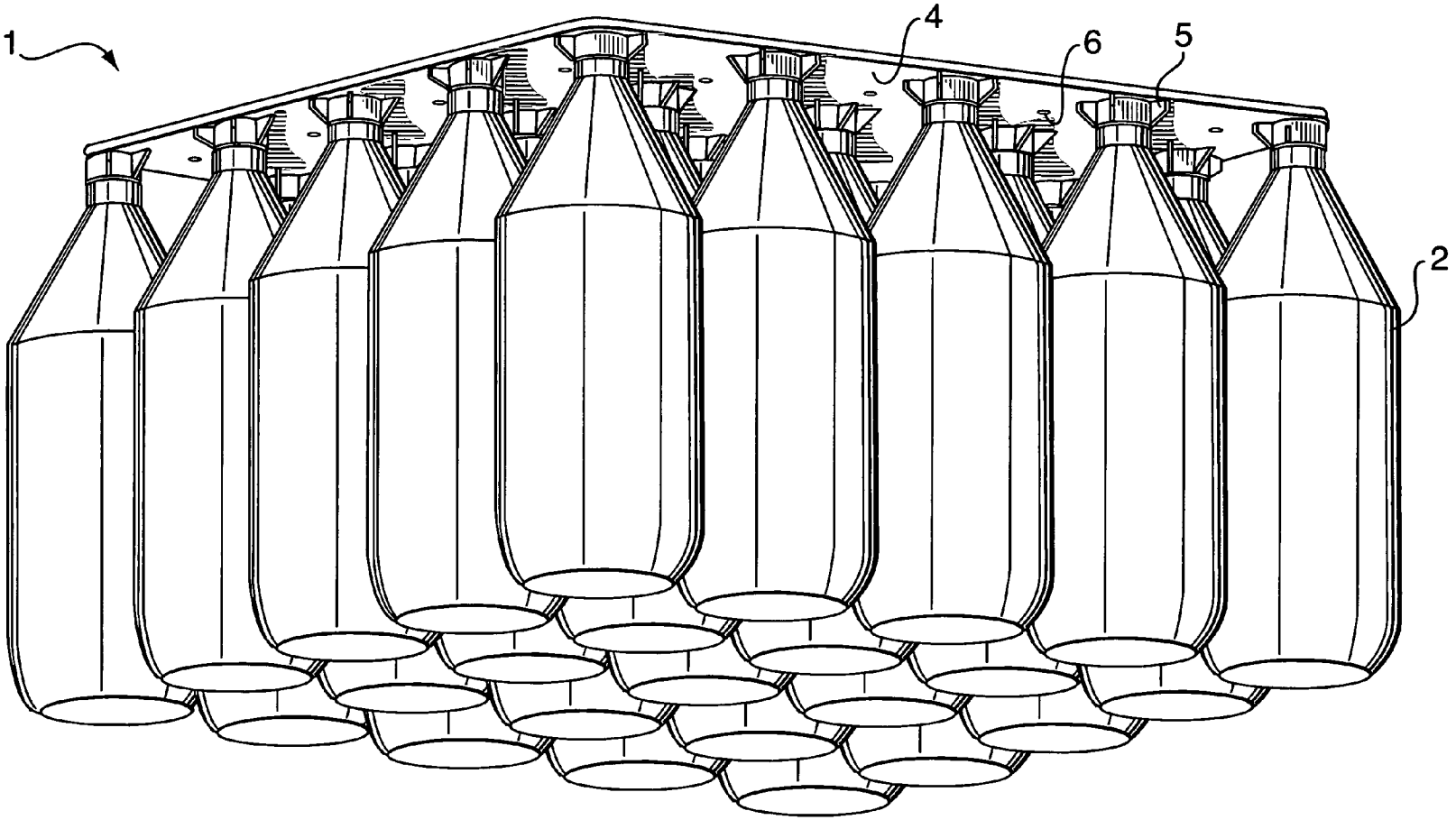
FIG. 3 is a perspective view of the frame of FIG. 1 into which 25 bottles are screwed.
Figure 4:
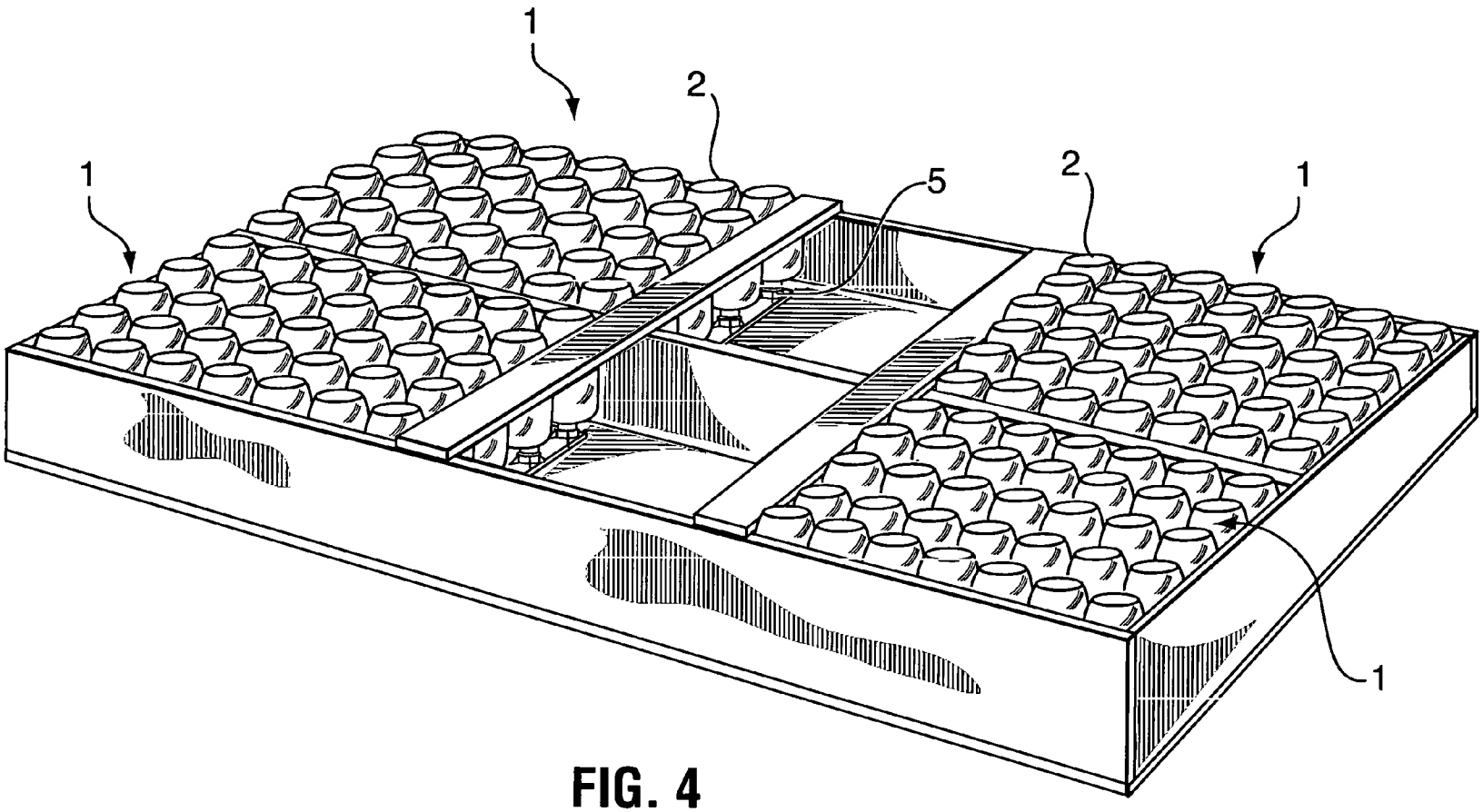
FIG. 4 is a perspective view showing four frames according to an embodiment of the present invention into which bottles are screwed and which are attached to a dock structure.

A frame 1 according to an embodiment of the present invention is illustrated in FIGS. 1 to 3. The frame 1 is illustrated on its own in FIG. 1 and in cooperation with bottles 2 in FIGS. 2 and 3 as described below. The frame 1 comprises a surface 4 and an array of female screw portions 3 thereon. The female screw portions 3 are each of substantially cylindrical form with a threaded interior. The female screw portions 3 are adapted to receive male screw portions of bottles 2 such as two-liter plastic pop bottles. The female screw portions 3 comprise eight supports 5 extending in an outward radial direction with respect to each screw portion 3. The surface 4 includes apertures 6 which can be used to attach the frame to a dock structure 7 as seen in FIG. 4 in which four frames are used.

Arrangement of the female screw portions 3 relative to the surface 4 is dependent on the size of the bottle to be used and the desired shape of the surface 4. The size and dimensions of the female screw portions 3 are dependent on the size and dimensions of the male screw portions of the bottles 2 which are to be used. If a standard two-liter plastic bottle is to be used, the diameter of each female screw portion should be approximately 1⅛ in. and if a square grid configuration having contacting bottles is desired (as seen for example in FIG. 3), the distance between the centers of each of the female screw portions 3 should be approximately 4⅜ in. In such a square grid configuration adapted to result in contacting bottles, the dimensions of the surface may advantageously be 1' 6¾" by 1' 6¾" and if bottles 2 are screwed into the frame 1 the outer dimensions of the array of bottles are 1' 9⅞" by 1' 9⅞".

In one embodiment of the present invention the frame and, in particular each female screw portion, is adapted to cooperate with an inner gasket to help ensure an air-tight seal. Such a gasket may be provided as part of the frame or otherwise.

Many different sizes and shapes of the frame 1 are contemplated for use in conjunction with a variety of dock structures. In fact, multiple frames 1 may be used with a single dock structure as seen in FIG. 4. The shape of the frame 1 is not specifically limited and could be, for example, annular, triangular, rectangular and may include at least one internal cavity such as in a donut shape.

Because the bottles are screwed into the device, should one or more bottles become damaged, it/they may be replaced without the need for an involved procedure requiring special tools. The replacement may preferably be performed by the end user.

An alternative to the female screw portions is another means to receive containers such as two-liter pop bottles, such that the attachment is removable, secure and provides a good seal such as a clamp or a plug, over which the open end of the bottle can be pressed to create a secure structure and fluid-tight seal.

In an alternative embodiment the frame comprises a means to secure containers in place using a locking system in order to prevent potential tampering. The locking mechanism is typically in the form of an additional thread 10 provided in the female screw portion 3. In another embodiment, the frame comprises a means to secure containers in place so that the containers are not readily removable.

Referring to a system using a frame of the present invention, certain bottles may be partially filled or substantially filled with a liquid such as water, in order to adjust the flotation and buoyancy characteristics. The degree and geometric properties of flotation are dependent, in part, upon which female screw portions are occupied, that is, the location and number of bottles which are in place. In one embodiment, means to hold the bottles in tight cooperation is provided in order to distribute the stresses. Such a means may be a strap which can be placed around the bottles or may be provided by a dock structure.

A dock structure used in conjunction with a frame of the present invention may include many features such as a means of anchorage, ladder or slide.

INDUSTRIAL APPLICABILITY

The frame for attachment to a dock structure having means to receive containers as taught herein generally provides improved means of assembling flotation devices such as, for example, cottage docks; floating bridges such as those used by all terrain vehicles, lawn tractors, golf carts; island docks, mooring docks for boats; floats for an anchor; or boardwalks.

The invention claimed is:

1. A frame (1) for attachment to an underside of a dock structure to provide buoyancy thereto, characterized by:

a generally planar frame portion (4);

a plurality of receiving members (3), attached to said frame portion (4) and each adapted to receive a hollow container (2) by holding and sealing an open end of said container (2), each of said receiving members (3) comprising a plurality of supports (5) extending in an outward radial direction with respect to each receiving member (4); and means for attaching said frame (1) to the underside of a dock structure, such that each of said hollow containers (2) depends from said frame (1) and is detached from one another, and wherein said containers provide a buoyancy effect to said dock structure.

2. A frame (1) according to claim 1 wherein each receiving member (3) comprises a female screw portion adapted to receive a male screw portion of one of said containers (2).

3. A frame (1) according to claim 1 wherein each receiving member (3) comprises a substantially cylindrical portion extending normally from said frame portion (4).

4. A frame (1) according to claim 1 wherein each receiving member (3) further comprises a plug adapted to receive said containers (2).

5. A frame (1) according to claim 1 wherein said attaching means comprises a plurality of apertures in said frame (1) through which fastening means, used to attach said frame to said underside of said dock structure, may be inserted.

6. A frame (1) according to claim 5 wherein said fastening means comprises at least one screw.

7. A frame (1) according to claim 1 wherein said containers (2) comprise two-liter plastic drink containers.

8. A frame (1) according to claim 1 wherein said dock structure is a structure selected from the group consisting of a cottage dock, floating bridge, island dock, mooring dock for boats, float for an anchor and a boardwalk.

9. A frame (1) according to claim 1 wherein each receiving member (3) comprises an internal gasket to enable an air—and fluid—tight seal between each receiving member (3) and said container (2).

10. A frame (1) according to claim 1 wherein each receiving member (3) is oriented to enable the containers (2) to extend substantially normal to said frame (1).

11. A frame (1) according to claim 1 wherein said receiving members (3) are positioned on said frame (1) in a grid to allow said containers (2) to be arranged in a grid form.

12. A frame (1) according to claim 1 wherein said receiving members (3) are positioned on said frame (1) such that when the containers (2) are held by said receiving members (3), each container (2) contacts at least another container (2).

13. A frame (1) according to claim 1 wherein said frame portion (4) is substantially in the form of right angle quadrilateral.

14. A frame (1) according to claim 1 wherein each receiving member (3) further comprises a locking system which may be used to prevent potential tampering.

15. A frame (1) according to claim 1 wherein one or more of said receiving members (3) is attached to a corresponding container (2).

16. A frame (1) according to claim 1 wherein each of said receiving members (3) includes eight of said supports (5).

17. A frame (1) according to claim 1 wherein said dock structure is attached to said frame using said attaching means.

18. A dock system characterized by:

a dock structure; and a plurality of frames (1), each of said frames comprising a generally planar frame portion (4);

a plurality of receiving members (3), attached to said frame portion (4) and each adapted to receive a hollow container (2) by holding and sealing an open end of said container (2), each of said receiving members (3) comprising a plurality of supports (5) extending in an outward radial direction with respect to each receiving member (4); and means for attaching said frame (1) to the underside of a dock structure, such that each of said hollow containers (2) depends from said frame (1) and is detached from one another, and wherein said containers provide a buoyancy effect to said dock structure wherein said frames (1) are attached to an underside of said dock structure using said attaching means.

* * * * *